United States Patent [19]

Hunt et al.

[11] 4,055,349

[45] Oct. 25, 1977

[54] GOLF PUTTING PRACTICE DEVICE HAVING MECHANICAL CALCULATORS

[76] Inventors: Archie F. Hunt, Rte. 2 Box 140, Marietta, S.C. 29661; Jack J. Moss, 640 Ardleigh Drive, Akron, Ohio 44303

[21] Appl. No.: 679,061

[22] Filed: Apr. 21, 1976

[51] Int. Cl.[2] ..... A63B 69/36

[52] U.S. Cl. ..... 273/179 A; 235/92 GA; 273/184 A

[58] Field of Search ..... 273/177, 178, 179, 180, 273/127 C, DIG. 26, 184 A; 235/92 GA

[56] References Cited

U.S. PATENT DOCUMENTS

| | | | |
|---|---|---|---|
| 1,904,034 | 4/1933 | Walstrom | 273/179 B |
| 3,656,748 | 4/1972 | Howard | 273/DIG. 26 X |
| 3,785,552 | 1/1974 | Payne | 273/DIG. 26 X |
| 3,796,434 | 3/1974 | Moss et al. | 273/179 A |

*Primary Examiner*—George J. Marlo
*Attorney, Agent, or Firm*—Oldham & Oldham Co.

[57] ABSTRACT

A game device whereby one may improve his golf ball putting skill. Fundamentally, the invention comprises an arcuate shaped bottom surface having a vertical wall partially encompassing the same. The wall is discontinuous at a point and thus defines a receptacle for receiving balls putted toward the device. A front edge portion of the arcuate surface is characterized by the presence of a pivotal tongue which is actuated by a golf ball passing thereover. Connected to the tongue is a spring-loaded mechanical counter actuated by mechanical linkage to record the number of times a ball passes over the tongue. Interconnected within the receptacle is a second spring-biased mechanical counter which is actuated each time a ball is received within the receptacle and is functional to record the number of balls putted towards the device and passing up onto the arcuate surface.

10 Claims, 4 Drawing Figures

GOLF PUTTING PRACTICE DEVICE HAVING MECHANICAL CALCULATORS

BACKGROUND OF THE INVENTION

Numerous types of game devices are presently known whereby a golfer may improve his putting skill. Such devices are presented in U.S. Pat. Nos. 3,003,769; 3,134,497; 3,365,199; and 3,796,434 and normally utilize a tray whereupon there is a specific area designated as the cup on a putting green. As a golfer putts the ball towards this particular area, he most normally must determine for himself whether or not the ball passed over the cup. Further, if the golfer desires to keep track of the number of holes he has made with relation to the number of strokes he has taken, he must record this data for himself. Other than the last of the aforementioned patents, of which the instant applicants are the patentees, there is no other known putting device which provides means for automatically maintaining a running total of such statistics. While the applicant's own patent does indeed provide such a desirable feature, the apparatus utilized in achieving the desired result is an electromechanical one which is more expensive and complex than is preferably desired.

Consequently, it is an object of the instant invention to present a golf putter practice device which has means associated therewith for automatically determining the accuracy of a putt.

Another object of the invention is to present such a device wherein means are provided for automatically monitoring the number of strokes taken and the number of holes made.

Still a further object of the invention is to present such a device wherein the means for automatically monitoring the number of strokes and holes is totally mechanical and thus is less complex in structure and less expensive in implementation than corresponding devices known to date.

These objects and other objects which will become apparent as the detailed description proceeds are achieved by a device to aid in the improving of one's golf ball putting skill, comprising: a wall partially encompassing a bottom surface and defining a pocket therewith, the wall being characterized by a receptacle therein; a tongue pivotally mounted adjacent a front portion of the bottom surface to be depressed by the ball passing thereover; a first mechanical counter operatively connected to said tongue for actuation by the ball passing over said tongue; and a second mechanical counter operatively connected within said receptacle for actuation by the ball being received within said receptacle.

DESCRIPTION OF THE DRAWINGS

For an appreciation of the structure and operation of the apparatus comprising the invention, reference should be had to the following detailed description and accompanying drawings wherein.

DETAILED DESCRIPTION OF PREFERRED EMBODIMENT

Figure 1:
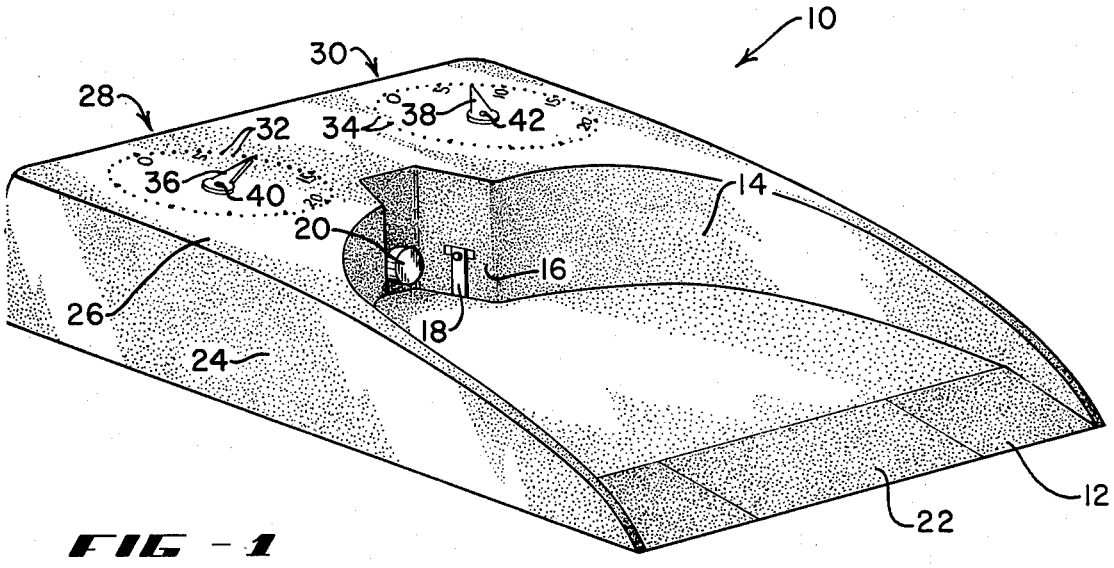
FIG. 1 is a perspective view of the external structure of the invention.

With reference now to the drawings, and more particularly FIG. 1, it can be seen that the preferred embodiment of the invention is designated generally by the numeral 10. A receiving surface comprising an arcuate plate 12 is provided for receiving balls putted toward the device. A wall 14 of substantially semi-circular nature encompasses the plate 12 and is characterized by the presence of a receptacle 16 centrally received in the back portion thereof. The arcuate plate 12 is such that, as encompassed by the wall 14, it is inclined at the open end thereof and then declines toward the receptacle 16 at its closed end. Consequently, balls putted towards the plate surface 12 rise up along the front inclined area to the top thereof and then drop along the declined back portion and are guided by the wall 14 into the receptacle 16. Received within the receptacle 16 is a momentary switch 18 which, upon being actuated by a ball received within the receptacle 16, is operative to actuate a solenoid plunger 20. The plunger 20 forces the ball out of the receptacle 16, up the rear portion of the plate 12 and back toward the user.

Centrally positioned along the front edge of the plate 12 is a tongue 22 which is preferably of the same width as the diameter of the hole on a standard putting green. As will become apparent hereinafter, the tongue 22 is deflected downwardly by the weight of a golf ball passing thereover; this deflection being operative to indicate that the ball is of adequate accuracy to constitute a hole made. Whether the ball passes over the tongue 22 or merely across the front inclined edge of the arcuate plate 12, it is ultimately received within the receptacle 16 and ejected via the switch-plunger combination 18-20.

The basic external structure of the device may be of any suitable nature but is preferably a molded plastic casing 24. Maintained on the rear top surface 26, are counters 28, 30 which respectively record the number of holes made for the number of strokes taken. Each of the counters 28, 30 is characterized by the presence of uniformly spaced markers 32, 34 to be designated by respective pointers 36, 38 rotatable about associated pins 40, 42.

As will become apparent hereinafter, the ejection of a ball from the receptacle 16 via the plunger 20 actuates the counter 30 to advance the pointer 38 a distance equivalent to the spacing between the markers 34. If the ball, in its path towards the receptacle 16, deflects the tongue 22 indicating that the hole has been made, the counter 28 records the same by advancing the pointer 36 a distance equivalent to the spacing between the markers 32.

Figure 2:
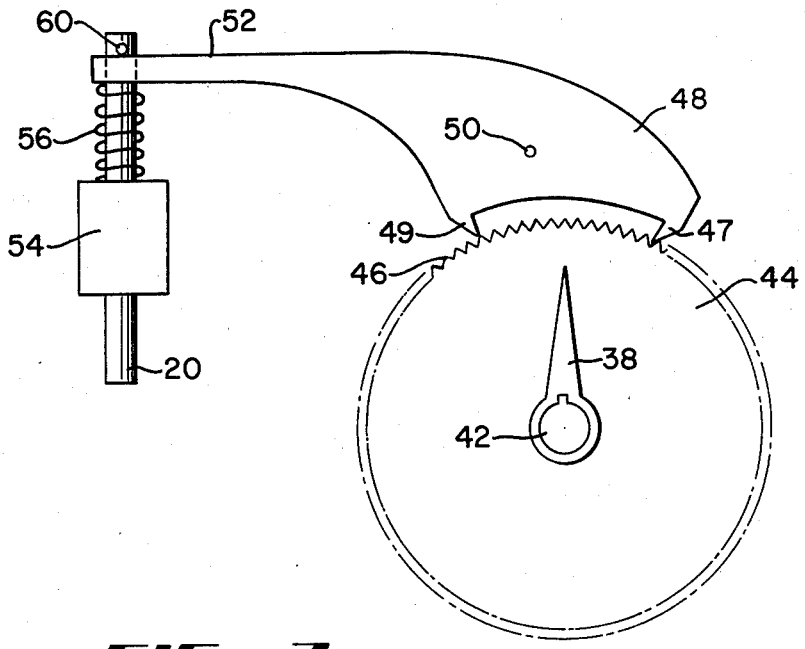
FIG. 2 is a top plan view of the ball return mechanism and the counter tabulating the number of strokes taken.

With reference to FIG. 2, the specific structure of the counter 30 may be seen. A ratchet wheel 44 having a plurality of uniformly spaced teeth 46 about the circumference thereof is provided with the aforementioned pin 42 perpendicularly attached thereto and extending upwardly through the top surface 26. The wheel 44 is maintained below this top surface 26 while the pointer 38 is fixedly secured to the pin 42 above the plateau casing. As will be elaborated upon hereinafter, the wheel 44 is spring biased such that it will have a natural tendency to rotate in a clockwise direction as shown in FIGS. 1 and 2. Limitation and regulation of the advancement of the ratchet wheel 44 is under control of the pawl 48. This pawl, having teeth 47, 49 on opposite ends thereof and in engagement with the teeth 46 of the wheel 44, is pivotal about a pin 50 under control of forces imparted upon the arm 52.

As noted hereinabove, the plunger 20 is solenoid actuated, being under control of the solenoid 54. While not shown, the solenoid 54 is electrically controlled via the momentary switch 18 in a standard manner as may be understood from a review of any of the aforementioned patents. Suffice it to say that, upon actuation of the switch 18, the solenoid 54 is excited so as to force the plunger 20 into the receptacle 16 and thus force engagement of the pin 60 and the arm 52. Such motion causes the pawl 48 to pivot around the pin 50 and allow the spring-biased ratchet wheel 44 to slightly advance in the clockwise direction. This advancement is equivalent to the spacing between the markers 34. When the momentary switch 18 causes the solenoid 54 to be deactivated, the spring 56 forces the return of the plunger 20. This movement causes engagement of the tooth 47 between the teeth 46 of the wheel 44 and is operative, under restraint of the spring 68 (FIG. 3), to maintain the wheel 44 in such position until a subsequent ball activates the switch 18. Thus, it can be seen that each ball entering the receptacle 16 causes a clockwise rotational movement of the wheel 44, and consequently the pointer 38 fixedly connected thereto, so as to advance the count of the number of strokes taken by the user when the solenoid plunger returns the ball.

Figure 3:
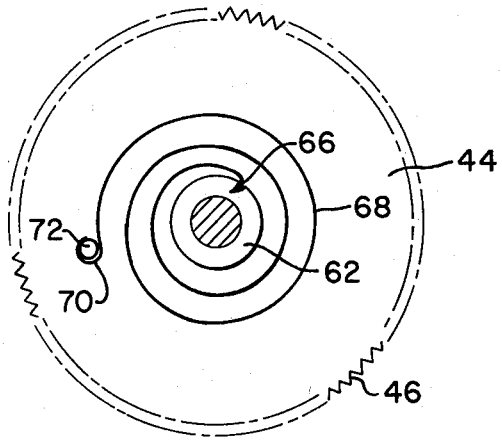
FIG. 3 is a bottom plan view of the mechanical counters of the invention.

As discussed hereinabove and as can be seen from the underside view of the wheel 44 shown in FIG. 3, the ratchet wheel 44 is spring-biased. An annular protrusion 62 is provided for rotational engagement about a post 64 which may be secured to the base of the unit 10. The annular protrusion 62 is notched as at 66 for receiving therein a helical spring 68 which is coiled about the protrusion 62. The end of the spring 68 is characterized by the presence of a hook 70 which makes engagement with a pin or post 72 which again may be affixed to the base or other portion of the unit 10. Manual rotational movement of the pointer 38 to a zero or starting position has a tendency to bias the spring 68 since it is secured and maintained at both ends via the notch 66 and the hook and post engagement 70, 72.

Figure 4:
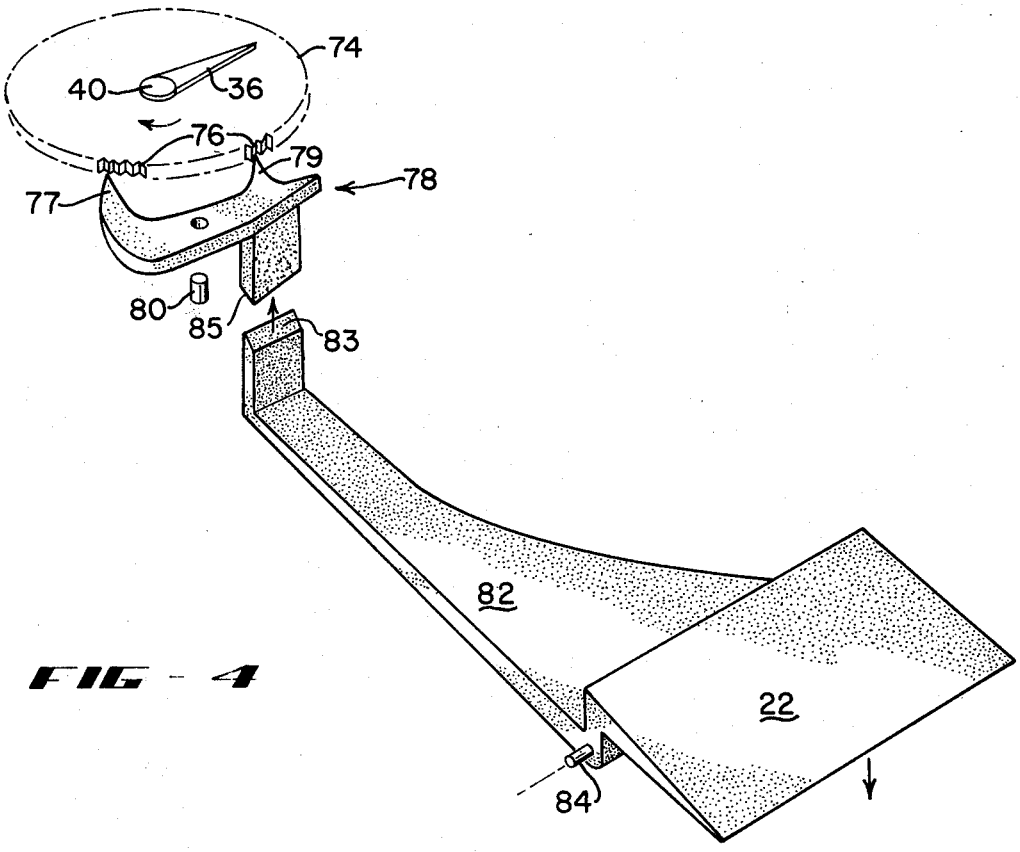
FIG. 4 is an illustrative view of the counter mechanism utilized in association with the sensing and recording of holes made.

Referring now to FIG. 4, it can be seen that the counter 28 is substantially similar in nature to the counter 30 discussed hereinabove, but for a variation in the means of actuation of the same. Suffice it to say that the ratchet wheel 74, having a plurality of uniformly spaced teeth 76 about the circumference thereof is again spring-biased in the manner as set forth in FIG. 3. A pawl 78, having teeth 77, 79 at opposed ends thereof, is operative to make engagement with the teeth 76. The pawl 78 is pivotal about the pin 80 under regulatory control of a linkage to be discussed directly below.

As set forth earlier, and as is somewhat common in the prior art, the tongue 22 is deflectable downwardly about the fulcrum 84 which comprises a front depending edge of the tongue 22. The deflection downwardly of the tongue 22 forces a lever arm 82 into engagement with the end of the pawl 78. The mating ends of the lever 82 and pawl 78 are beveled surfaces 83 and 85 such that the lifting of the end of the lever 82 about the fulcrum 84 causes the pawl 78 to pivot about the pin 80 thus allowing an advance of the spring-biased ratchet wheel 74. When the ball has passed over the tongue 22, the natural weight displacement of the lever 82 and positioning of the fulcrum 84 causes the lifting of the tongue 22 via the bar 88 and the maintaining of the pointer 36 at that marker indicative of the number of holes made.

It should be readily apparent that one using the device 10 may reset the counters 28, 30 by rotating the respective pointers 36, 38 to a starting point and thus adding tension to the associated helical spring. The teeth of the wheels 44, 74 are so angled with respect to the teeth of the pawls 48, 78 to allow unidirectional resetting rotation. The springs, so biased, are then ready to advance under control of the tongue 22 and solenoid 54.

Thus it can be seen that there is presented in the instant invention a unique apparatus for putting practice whereby the only electrical apparatus necessary is the solenoid-actuated plunger utilized for ejecting balls from the receptacle 16. The counter mechanisms, both for registering the number of strokes taken and the number of holes made, is solely mechanical in nature and thus relatively inexpensive to construct and reliable in operation. Clearly, substantially all of the elements of the invention may be constructed of a durable plastic material and thus be attractive in appearance, functional in operation, and durable for use over a long period of time.

While in accordance with the patent statutes, only the best mode and preferred embodiment of the invention has been presented and described in detail, it is to be understood that the invention is not limited thereto or thereby. Consequently, for an appreciation of the true scope and breadth of the invention, reference should be had to the appended claims.

What is claimed is:

1. A device for aiding one in improving his golf putting skill, comprising:

a wall having a receptacle therein and partially encompassing an arcuate bottom surface, said bottom surface having a depressable tongue positioned at a front portion thereof;

a first mechanical counter comprising a first ratchet wheel and pawl assembly; and a mechanical linkage comprising a lever arm operatively connected at one end to said tongue and having a first beveled surface at the other end thereof, said pawl having a second beveled surface thereon in juxtaposition to said first beveled surface, depression of said tongue actuating said counter via said linkage.

2. The device for aiding one in improving his golf putting skill as recited in claim 1 wherein said first ratchet wheel and pawl assembly is maintained within a casing having numerical designations thereon and wherein a pointer rides above said casing in juxtaposition to said numerical designations and in rotatable connection with said ratchet wheel.

3. The device for aiding one in improving his golf putting skill as recited in claim 1 which further includes a solenoid having a plunger extending external to a casing of said solenoid and being received within said receptacle, and a second mechanical counter in operative engagement with said plunger.

4. The device for aiding one in improving his golf putting skill as recited in claim 3 wherein said second mechanical counter includes a second ratchet wheel and pawl assembly, said pawl being actuated by movement of said plunger.

5. The device for aiding one in improving his golf putting skill as recited in claim 4 wherein said second ratchet wheel and pawl assembly is maintained within a casing having numerical designations thereon and wherein a pointer rides above said casing in juxtaposition to said numerical designations and in rotatable connection with said ratchet wheel.

6. The device for aiding one in improving his golf putting skill as recited in claim 3 wherein said first and second ratchet wheels are spring biased.

7. A golf putting practice device, comprising:

an arcuate surface partially encompassed by a wall having a receptacle therein, said arcuate surface having a depressable flap positioned at a front edge thereof;

a lever arm affixed at one end thereof to said flap and being beveled at another end thereof;

a first pawl having a beveled end in juxtaposition with the beveled end of said lever arm and being in operative engagement with said lever arm and in communication with a first spring biased ratchet wheel;

a solenoid received within said receptacle and having a plunger extending therefrom;

a second pawl in operative engagement with said plunger and in communication with a second spring biased ratchet wheel;

a casing covering said first and second ratchet wheels; and first and second pointers in rotatable connection with said first and second ratchet wheels respectively, said casing being interposed between said ratchet wheels and said pointers.

8. The golf putting practice device as recited in claim 7 wherein said casing has spaced numbered marks thereon and in juxtaposition to each of said pointers.

9. A device for aiding one in improving his golf putting skill, comprising:

a wall having a receptacle therein and partially encompassing an arcuate bottom surface;

a solenoid received within said receptacle and having a plunger extending therefrom; and a mechanical counter comprising a spring loaded ratchet wheel and pawl assembly, said pawl being in reciprocating engagement with said plunger.

10. The device for aiding one in improving his golf putting skill as recited in claim 9 which further includes a pointer connected to said ratchet wheel and rotatable therewith.

* * * * *